United States Patent [19]

Miller

[11] Patent Number: 4,473,927

[45] Date of Patent: Oct. 2, 1984

[54] TRIM FOR FABRIC MOUNTING TRACK SYSTEM

[76] Inventor: Lloyd C. Miller, 16842 Greenview La., Huntington Beach, Calif. 92642

[21] Appl. No.: 472,518

[22] Filed: Mar. 7, 1983

[51] Int. Cl.[3] ..... A47H 1/00

[52] U.S. Cl. ..... 24/461; 24/462; 16/87.4 R; 16/95 R

[58] Field of Search ..... 16/96 R, 96 D, 95 R, 16/95 DW, 95 D, 94 R, 94 D, 87.4 R, 87.4 W, 87.6 R, 87.6 W, 87 R, 93 D, 385; 24/460, 462, 459, 152, 489, 517, 518; 160/19, 327, 392–395; D8/376, 377; 248/251, 304, 309

[56] References Cited

U.S. PATENT DOCUMENTS

| | | | |
|---|---|---|---|
| 3,693,696 | 9/1972 | Salzmann | 16/95 |
| 3,871,082 | 3/1975 | Pflum | 16/96 D |
| 4,197,686 | 4/1980 | Baslow | 160/327 |

FOREIGN PATENT DOCUMENTS

| | | | |
|---|---|---|---|
| 2950279 | 6/1981 | Fed. Rep. of Germany | 16/96 D |

*Primary Examiner*—James M. Meister
*Assistant Examiner*—J. L. Knoble
*Attorney, Agent, or Firm*—Edwin A. Oser

[57] ABSTRACT

A trim for a fabric mounting track system as disclosed and claimed in the applicant's prior application, Ser. No. 441,990, filed on Nov. 16, 1982. The trim consists basically of a unitary substantially F-shaped structure having a flat trim portion. There is preferably a retaining portion extending at right angles to the trim portion, as well as an intermediate portion, also extending from the trim portion and at right angles thereto and spaced from the retaining portion. The retaining and intermediate portions are arranged to fit precisely over one of the hinge lock or back support plates of the track mounting system. The trim portion fits over the two plates to provide a pleasing appearance and to lend mechanical rigidity to the mounting track system.

9 Claims, 4 Drawing Figures

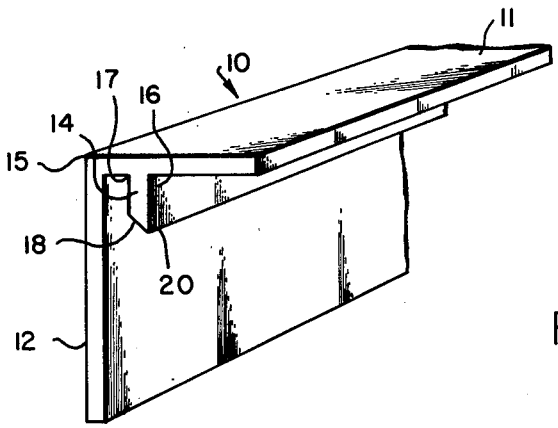
Fig. 1.
Fig. 4.
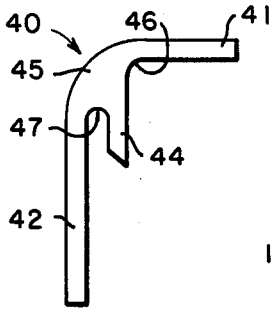
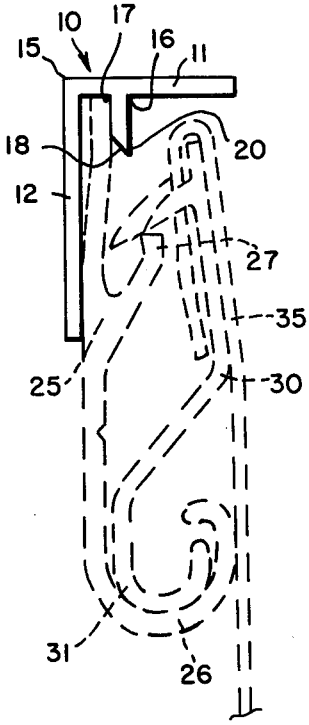
Fig. 3.
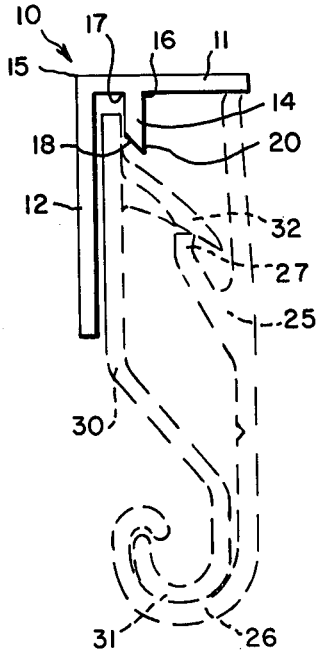
Fig. 2.

TRIM FOR FABRIC MOUNTING TRACK SYSTEM

BACKGROUND OF THE INVENTION

This invention relates generally to fabric mounting track systems and particularly relates to a trim for such a track system.

The track system has been disclosed and claimed in the applicant's prior application entitled, "Fabric Mounting Track System," filed on Nov. 16, 1982, Ser. No. 441,990.

In the prior application a fabric mounting track system is disclosed which includes a hinge lock plate having a plurality of lancings which may be of two different sizes, and at one end a first open hinge portion. It further includes a back support plate which may be secured to a wall, or the like, and has a second open hinge portion adapted to fit the hinge portion of the hinge lock plate. The back support plate has an inwardly projecting ledge. As a result, when the two plates are hinged together, they may be rotated through an angle of substantially 180°, whereby the larger size lancings partially overlay the ledge.

For further details of the fabric mounting track system, reference is made to the applicant's prior application, which is included herein by way of reference.

It has been found that the mounting track, after it has secured a fabric to the wall, may be mechanically unstable. This is true particularly because a great force has to be exerted on the upper mounting track when the fabric is pulled downwardly on the wall to give it sufficient tension so that it will be smooth and somewhat spaced from the wall. Furthermore, in some instances it may be desired to close up the open portion of the mounting track, which may be unsightly.

SUMMARY OF THE INVENTION

Accordingly, the present invention provides a trim which is designed to secure itself to and to overlay the mounting track. The trim consists of a unitary structure which is substantially of "F" shape. It includes a flat trim portion, a retaining portion extending at right angles to the trim portion and an intermediate portion also extending from the trim portion and at right angles thereto.

The trim portion is adapted to extend over the open ends of the two plates; that is, the hinge lock plate and the back support plate. The retaining portion is adapted to extend rearwardly of one of the two plates. Finally, the intermediate portion is adapted to extend over the front surface of the one plate.

It should be noted that the intermediate portion has a length so that it terminates short of the lancings.

The resulting composite structure provides mechanical strength and rigidity to the fabric mounting track. It also covers the otherwise open top portion of the hinge lock and back support plates. It should also be noted that the unitary structure extends along the entire length of the mounting track system. Preferably the trim is secured to the hinge lock plate.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

BRIEF DESCRIPTION OF THE DRAWING

FIG. 1 is a view in perspective of a portion of the trim for a fabric mounting system and embodying the present invention;

FIG. 2 is a side elevational view of the embodiment of FIG. 1 with the fabric mounting track shown in phantom lines and the trim mounted in the preferred position;

FIG. 3 is a side elevational view of the embodiment of FIG. 1, with the fabric mounting track shown in phantom lines and the trim shown in another position on the mounting track, and FIG. 4 is a side elevational view of a modified trim for the fabric mounting track system.

DESCRIPTION OF THE PREFERRED EMBODIMENT

Referring now to the drawing and particularly to FIGS. 1 and 2, there is illustrated a unitary structure 10 which may, for example, consist of metal. Preferably it is made of extruded aluminum. The structure 10 includes a flat trim portion 11, a retaining portion 12, and an intermediate portion 14. It will be noted that the structure 10 is generally F-shaped. The retaining portion 12 forms a right angle with the flat trim portion 11. The intermediate portion 14 depends from the trim portion 11 and is substantially parallel to the retaining portion 12; that is, it also extends at right angles to the trim portion 11.

It will be noted that the outer surface between the trim portion 11 and the retaining portion 12 forms a sharp corner at a 90° angle. Similarly, the intermediate portion 14 forms a sharp 90° angle with the trim portion 11, as shown at 16 and 17.

It will further be noted that the free end of the intermediate portion 14 forms an angle of approximately 45° with the remainder thereof, as shown at 18. The sharp edge 20 points away from the retaining portion 12.

FIG. 2 shows, besides a side view of the unitary structure 10, a mounting track system in phantom lines, as disclosed and claimed in the applicant's prior application hereinbefore referred to. The mounting track system includes a back support plate 25 having an open hinge portion 26 and an outwardly projecting ledge 27. The hinge lock plate 30 also has an open hinge portion 31 so that the two plates can be nested together and rotated through 180°. One or more lancings 32 are made in the hinge lock plate and these lancings may be of different sizes. The larger size lancings slightly project over the ledge 27.

As shown in FIG. 2, the retaining portion 12 extends along the back surface of the hinge lock plate 30. The intermediate portion 14 extends over the front surface of the hinge lock plate 30. Accordingly, the two portions 12 and 14 of the unitary structure 10 are nested between and locked to the hinge lock plate 30. It will be understood that the mounting of the unitary structure 10 over the two plates 25 and 30, as shown in FIG. 2, is a preferred form of the present invention.

However, it is also feasible to mount the unitary structure 10 over the mounting track system including the back support plate 25 and the hinge lock plate 30 may be secured as shown in FIG. 3.

It will be seen that the retaining portion 12 extends along the back surface of the back support plate 25. On the other hand, the intermediate portion 14 extends over the front surface of the back support plate so that the two portions 12 and 14 between themselves are nested between and locked to the back support plate 25.

As explained hereinbefore, the intermediate portion 14 should stop short of the lancings 32. The flat trim portion 11 extends over the two plates; that is, the back support plate and the hinge lock plate, when they are closed.

FIG. 3 also shows a portion of a fabric 35 which is wrapped around the free end of the hinge lock plate and is pierced by a lancing 32 for a secure hold.

It will be understood that the trim of the invention should be secured to both the mounting track between which the fabric extends and is held thereby. Also, as explained hereinabove, the trim portion 11 tends to hide the top of the mounting track and the turned-over portion of the fabric.

FIG. 4, to which reference is now made, shows another modification of the trim of the present invention. It is generally designated 40 and may be called a "bull-nosed," substantially F-shaped section of unitary construction. The structure 40 again has a flat trip plate 41, a retaining portion 42 and an intermediate portion 44. Generally the portions 42 and 44 are parallel to each other and when extended, form an angle of 90° with the trim portion 41. However, the outer surface interconnecting the trim portion 41 and the retaining portion 42, as shown at 45, is rounded to form, in essence, a "bull nose." Similarly, the intermediate portion 44 forms a rounded section 46 with the trim portion 41 and another semicircular portion 47 with the retaining portion 42.

By way of example, the dimensions of the structure 10 are as follows: The retaining portion 12 has a length of 0.875" or $\frac{7}{8}$ inch. The trim portion 11 has a length of 0.562". The height of the intermediate portion 14, as measured from the back surface of the trim portion 11, is 0.250" or $\frac{1}{4}$ inch. The length of the tapered tip 18 of the intermediate portion may be 0.062" or 1/16 inch. The thickness of the metal may be 0.062" or 1/16 inch. The spacing between the two portions 12 and 14 may be 0.070".

The dimensions of the structure 14 are similar. The radius of the "bull-nose" portion 45 is 0.250". The radius at corner 46 is 0.056" and the semicircular area 47 has a radius of 0.035". The distance from the outer surface of the trim portion 41 to the sharp tip of the intermediate portion 44 is 0.438". Preferably the unitary structures 10 and 40 are made of extruded aluminum.

There has thus been disclosed a trim for a fabric mounting track. The trim serves the purpose to provide mechanical stability and rigidity to the mounting track, and further, it enhances the appearance of the track mounting system. It has two portions; that is, a retaining portion and an intermediate portion between which the back support plate or the hinge lock plate is wedged. It has a trim portion which extends over the two plates; that is, the back support plate or the hinge lock plate. The intermediate portion is relatively short so that it does not interfere with any of the lancings on the hinge lock plate. It also has a sharp edge facing generally toward the hinge lock plate and which may help to secure the fabric in the mounting track.

What is claimed is:

1. In a fabric mounting track system of the type including a hinge lock plate and a back support plate for supporting a fabric on a wall or the like, the hinge lock plate having a plurality of lancings and a first open hinge portion, and the back support plate being adapted to be secured to a wall and having a second open hinge portion adapted to fit the first hinge portion and an inwardly projecting ledge whereby when the two plates are hinged together and adjacent to each other, the lancings partially overlay the ledge, wherein the improvement comprises a trim for the mounting system;

(a) a unitary substantially F-shaped structure having a flat trim portion;

(b) a retaining portion extending at right angles to said trim portion; and (c) an intermediate portion extending from said trim portion and at right angles thereto, said trim portion being adapted to extend over the open ends of the two plates, said retaining portion being adapted to extend rearwardly of one of the plates, and said intermediate portion being adapted to extend over the front surface of one of the plates, said intermediate portion having a length so as to terminate short of the lancings, thereby to provide mechanical strength and rigidity to the fabric mounting track system, said unitary structure extending along the length of the mounting track system.

2. In a fabric mounting track system as defined in claim 1, wherein said intermediate portion and said retaining portion are disposed over the hinge lock plate.

3. In a fabric mounting track system as defined in claim 1, wherein said retaining portion and said intermediate portion fit over the back support plate.

4. In a fabric mounting track system as defined in claim 1 wherein said intermediate portion has a free end forming an angle of substantially 45° with the remainder of said intermediate portion to provide a sharp edge away from said retaining portion.

5. In a fabric mounting track system as defined in claim 1 wherein said trim portion and said retaining portion form a sharp 90° outer end portion and said intermediate portion forming two 90° angles with said trim portion in the area where it joins said trim portion.

6. In a fabric mounting track system as defined in claim 5 wherein said unitary structure is of extruded aluminum.

7. In a fabric mounting track system as defined in claim 1 wherein said trim portion and said retaining portion form on the outside a rounded surface and wherein said intermediate portion forms a rounded section between said intermediate portion and said retaining portion and between said intermediate portion and said trim portion.

8. In a fabric mounting track system as defined in claim 7 wherein said intermediate portion has a free end forming an angle of substantially 45° with the remainder thereof to provide a sharp edge disposed away from said retaining portion.

9. In a fabric mounting track system as defined in claim 7 wherein said unitary structure is of extruded aluminum.

* * * * *